US006450721B1

(12) United States Patent
D'Amico et al.

(10) Patent No.: US 6,450,721 B1
(45) Date of Patent: Sep. 17, 2002

(54) STYLUS AND RETRACTABLE PEN

(75) Inventors: Richard Joseph D'Amico, Cranston; Gregor Mittersinker, Warwick; Raul Pereira, Cumberland, all of RI (US)

(73) Assignee: A.T.X. International, Inc., Lincoln, RI (US)

( * ) Notice: Subject to any disclaimer, the term of this patent is extended or adjusted under 35 U.S.C. 154(b) by 0 days.

(21) Appl. No.: 09/931,824

(22) Filed: Aug. 17, 2001

(51) Int. Cl.[7] ..... B43K 1/10
(52) U.S. Cl. ..... 401/258; 401/195
(58) Field of Search ..... 401/258, 99, 104, 401/116, 117, 202, 243, 6, 52, 195, 196; D19/36, 43, 49, 55, 56, 57

(56) References Cited

U.S. PATENT DOCUMENTS

D183,676 S * 10/1958 Bickley et al.
D248,865 S * 8/1978 Sussman et al. ..... D19/43
4,161,374 A * 7/1979 Koeln et al. ..... 401/116
D316,109 S * 4/1991 Pappageorge ..... D19/48
D356,598 S * 3/1995 Thompson et al. ..... D19/49
D372,497 S * 8/1996 Lamber
D389,131 S * 1/1998 Nagaoka ..... D14/114
D398,642 S * 9/1998 Avenatti ..... D19/48
D436,126 S * 1/2001 Rosenbaum ..... D19/36
D441,061 S * 4/2001 Lai ..... D19/49
D442,632 S * 5/2001 Ono ..... D19/36
6,227,743 B1 * 5/2001 Robb ..... 401/243

* cited by examiner

*Primary Examiner*—Gregory Huson
*Assistant Examiner*—Huyen Le
(74) *Attorney, Agent, or Firm*—Noraro & Michalos P.C.

(57) ABSTRACT

A stylus for a handheld computing device has a clip with detents and spaced apart ribs for securing the stylus in a stylus slot of the handheld device. The clip has grooves on the outward-facing surface, making the clip easier to grasp in order to remove the stylus from the stylus port. The stylus can include a replaceable, retractable ball point pen tip extending from the end of the stylus opposite the stylus tip.

8 Claims, 3 Drawing Sheets

STYLUS AND RETRACTABLE PEN

FIELD AND BACKGROUND OF THE INVENTION

The present invention relates generally to the field of writing instruments and in particular to a new and useful stylus with a retractable pen adapted for storage in a side slot of many types of personal digital assistants.

Personal digital assistants (PDAs) or handheld computing devices are becoming more and more popular. Typically, these devices are too small to incorporate a keyboard, and so a non-marking stylus is required to enter data and make selections on a touch-sensitive screen of the devices. Examples of these devices include the M100 and M505 sold by Palm, Inc. of Santa Clara, Calif., JORNADA sold by Hewlett-Packard of Palo Alto, Calif. and CASSIOPEIA sold by Casio, among others.

PDAs and handheld computing devices commonly have a slot, or stylus port, in the side of the device adapted to hold a plain plastic stylus (sometimes referred to as a "nail" because of its appearance) These stylii are simple elongated rods having a stylus tip at one end and sized to be inserted and retrieved from the stylus port in the PDA casing side. The stylii provided with most PDAs sold at retail are simply non-marking stylii of the "nail" type.

PDAs have the limitation that most printers are not sized to be portable, and so data that is stored on a PDA can only be converted to a hard copy by either manually writing down the information displayed on the PDA screen, or connecting to a laptop or desktop computer with a printer and transferring data for printing. For the simple job of writing down a telephone number or short address, the latter option is very impractical. As a result, it is often necessary for PDA users to carry both pens and stylii in order to use the PDA without damaging the screen and still be able to create pen on paper notes.

Stylii combined with pens are generally known, such as the one taught by U.S. Pat. No. 5,913,629, in which a stylus tip is provided on one side of the pen point for a retractable pen tip. The pen tip extends past the stylus tip when it is in a use position.

U.S. Pat. No. 5,564,850 discloses a combined pen and stylus writing instrument having the pen tip at one end of the instrument and the stylus tip at the other.

Neither of these pens is disclosed as being particularly suited to be held in the side slot of a PDA.

Although many handheld computing devices have stylus ports for holding stylii, there are few mechanisms for keeping a stylus in place in the slot. Generally, stylii are simply held by a frictional fit between components. At least one known stylus, for example, has small hemispherical projections on the sides of the stylus body for mating with corresponding recesses inside a complimentary- stylus port. However, this feature can result in some difficulty experienced when removing the stylus from the handheld computing device or PDA. Alternatively, in some cases, it is possible that a stylus inserted into a PDA casing stylus port will fall out when the device is turned with the stylus port opening facing downward.

SUMMARY OF THE INVENTION

It is an object of the present invention to provide a combined stylus and pen for easy use and storage with handheld computing devices.

It is a further object of the invention to provide a stylus which can be removably held securely in a slot of a handheld computing device provided for receiving a stylus.

Accordingly, a combined pen and stylus writing instrument is provided having a retractable refillable pen tip extending from a pen point at one end of an elongated cylindrical housing and a non-marking stylus mounted on the other end of the housing. The stylus is mounted to the end of a pen activation cap at the end of the housing opposite the pen point.

A clip extends from one side of the pen activation cap below the stylus. A pair of detents are provided, one on each side of the clip, for engaging extensions from the edges of a stylus port on a PDA or handheld computing device. The outer surface of the clip has a series of grooves for making the stylus clip easier to grip and exert sufficient force on the stylus to remove it from a stylus port. A pair of ribs are located 180° apart, arranged symmetric around the clip. The ribs help retain the stylus in the stylus port by increasing frictional fit.

The various features of novelty which characterize the invention are pointed out with. particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
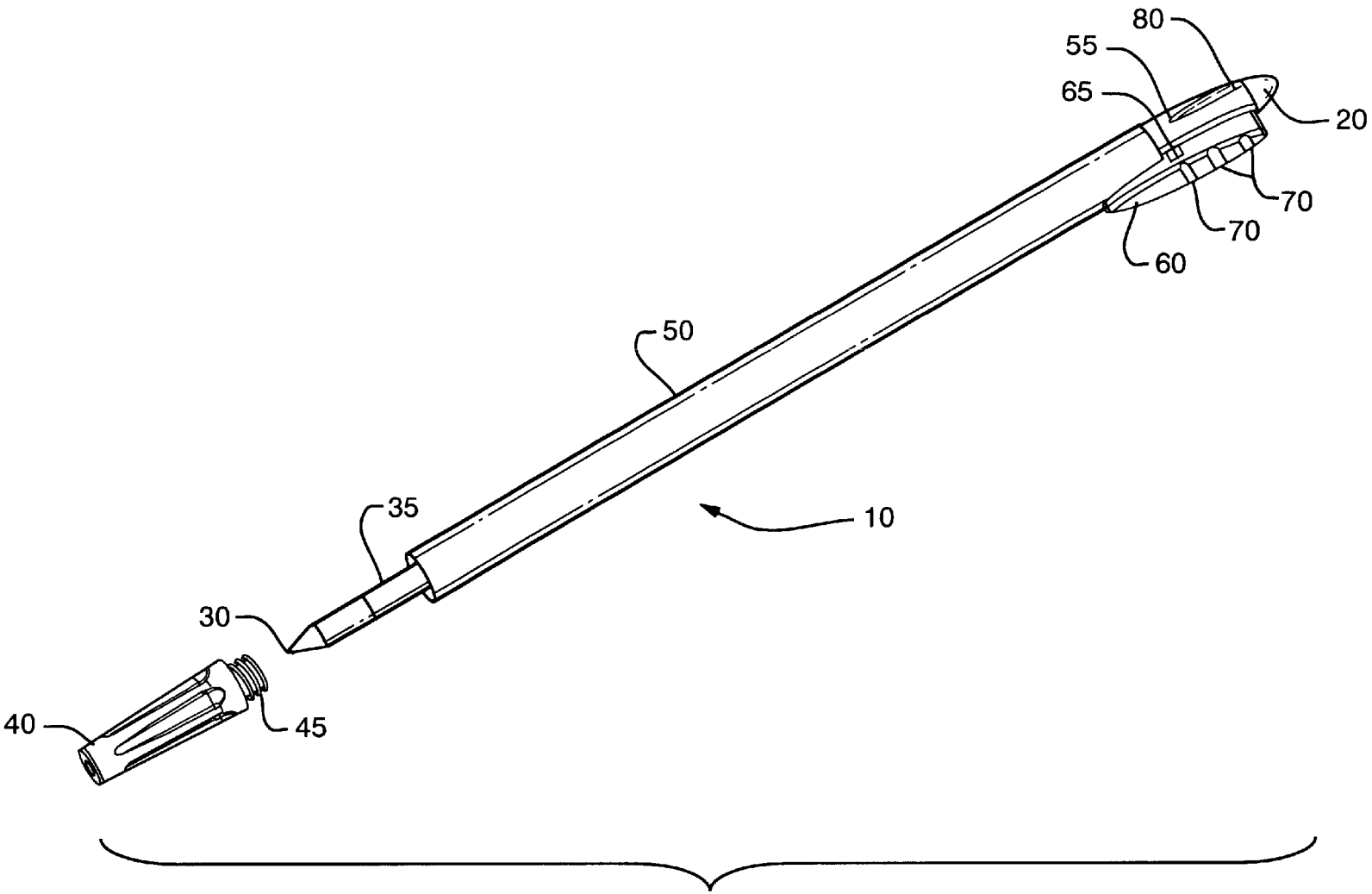
FIG. 1 is an exploded perspective view of a combined stylus and pen of the invention.

Referring now to the drawings, in which like reference numerals are used to refer to the same or similar elements, FIG. 1 shows a combined pen and stylus writing instrument 10 for a handheld device, such as a PDA or handheld computer, having a stylus port.

The writing instrument 10 is preferably between about 3 and 5 inches long for use with most commercially available handheld computing devices having stylus ports, but can be varied to fit a particular device. The writing instrument 10 is most preferably about 4 inches long. The diameter of the writing instrument housing 50 is also selected to fit the stylus ports of existing handheld computing devices, and can be sized as necessary. The diameter is preferably between 3/32 inch and 0.25 inch, and most preferably about 1/8 inch.

The writing instrument 10 has a removable pen point 40 at one end of elongated cylindrical housing 50. A pen tip 30 of a refill cartridge 35 is extended and retracted through the pen point 40 for use and storage, respectively. A non-marking stylus point 20 is provided at the other end of the writing instrument 10.

A pen activation cap 55 is located at the opposite end of the housing 50 from the pen point 40. The pen activation cap 55 is rotatably secured to the housing 50 for extending and retracting the pen tip 30 from within the housing 50 by activating a propelling and retracting mechanism inside the housing. The propelling and retracting mechanism can be any known mechanism that can be scaled to fit the housing 50 and, activated by relative rotation of components. The non-marking stylus point 20 is mounted. on the free end of the pen activation cap 55.

Figure 2:
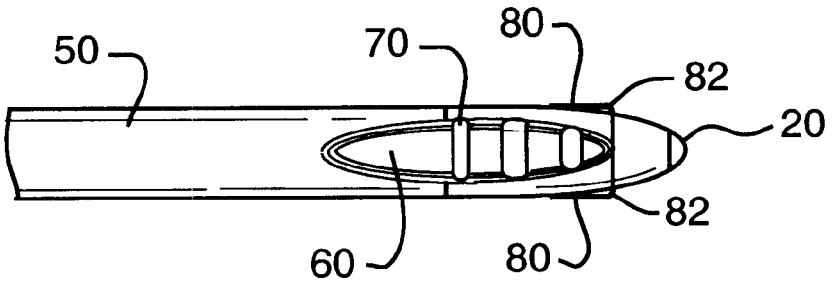
FIG. 2 is a top plan view of the stylus end of the stylus and pen of FIG. 1.
Figure 3:
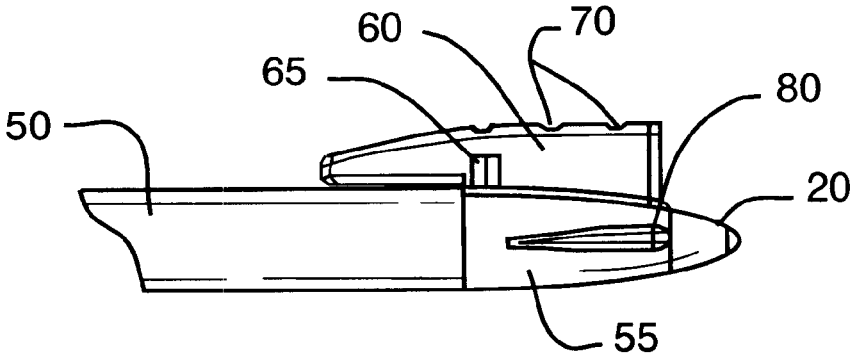
FIG. 3 is a side elevation view of the stylus end of FIG. 2.

As seen in FIGS. 1–3, a clip 60 is formed on one side of the pen activation cap 55 and extends longitudinally from below the stylus point 20 over a portion of the upper end of housing 50. The clip 60 may move freely over the surface of housing 50 when the pen activation cap 55 is rotated. The clip 60 may contact the surface of the housing 50, but it is preferably spaced above the surface of the housing 50 to increase the freedom of rotational movement and provide a small space for clipping the writing instrument 10 over a thin object, such as a shirt pocket or a small stack of paper.

The clip 60 preferably has a generally oval or elliptical shape, with convex side surfaces and rounded top and bottom points. The clip 60 is preferably formed integral with the pen activation cap 55, but they can be separate components secured together.

The clip 60 includes horizontal grooves 70 on the outward-facing surface of the clip 60. Preferably there are three grooves 70, but there can be as few as one groove 70. The upper limit for the number of grooves 70 is limited simply by the size of the clip 60, since there needs to be enough space to form both grooves and ridges in the clip outer surface. When the clip 60 is about 0.5 inch in length, the number of grooves 70 should not exceed about 7. Clearly, if the clip 60 is made longer, then additional grooves 70 can be added.

The clip 60 further includes a pair of detents 65, one in each side surface of the clip 60. The detents 65 are preferably located on the clip 60 at a point just above the upper end of the housing 50 where the pen activation cap 55 is connected.

Figure 4:
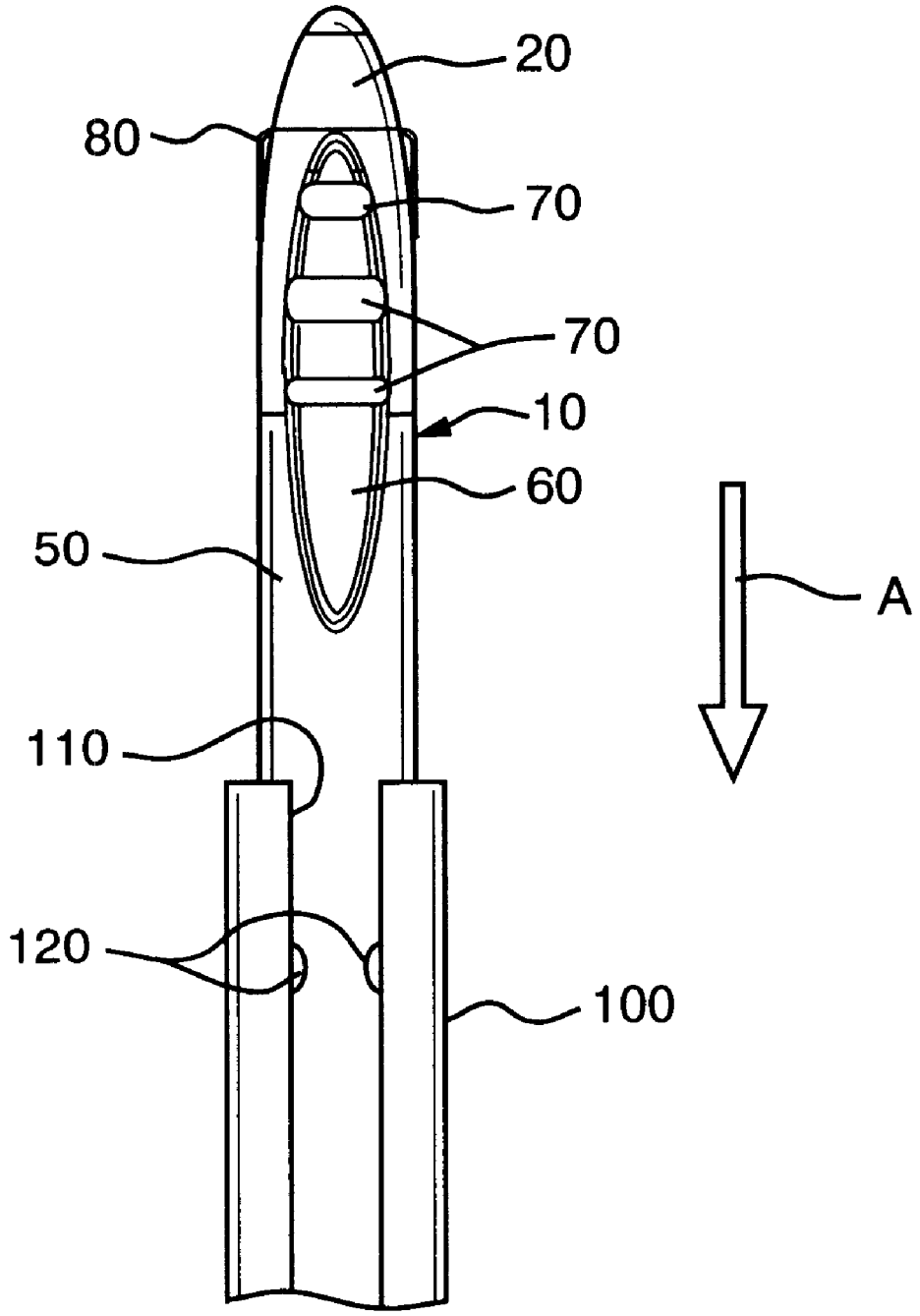
FIG. 4 is a side elevation view of a stylus of the invention being inserted in the stylus port of a handheld computing device.

FIG. 4 illustrates how the detents 65 can be used to interact with projections or barbs 120 on the edges of a stylus port 110 of a handheld computing device 100. The writing instrument 10 is slid into stylus port 110 in the direction of arrow A until detents 65 (not visible in FIG. 4) are even with the projections 120, and the projections 120 fit into the detents 65. The projections 120 and detents 65 work to hold the writing instrument 10 in place within the stylus port 110. Grooves 70 provide a gripping surface for assisting in the removal of the writing instrument 10 from the stylus port 110.

Another feature of the writing instrument 10 which works to hold it in a stylus port 110 is ribs 80. A pair of ribs 80 are positioned 180° apart on each side of the pen activation cap 55, spaced evenly from the clip 60. Ribs 80 have a generally triangular shape, as they continue the contour of the housing 50, as the pen activation cap 55 tapers toward the end of the stylus tip 20.

The ribs 80 provide the same width to the writing instrument 10 at the upper end as along the length of housing 50. Alternatively, the ends 82 of the ribs may extend slightly wider than the housing 50. Thus, when the writing instrument 10 is inserted in a correspondingly sized stylus port 110, the ribs continue to contact the sides of the stylus port 110 and provide a frictional fit in the port 110. The strength of the frictional fit is increased when the distance between the ends 82 is made greater than the width of housing 50.

The ribs 80, grooves 70 and clip 60 each additionally serve to provide a positive grip for rotating the pen activation cap 55 to propel and retract the refill cartridge 35 between the use and storage positions in the writing instrument 10.

Referring again to FIG. 1, as seen, the pen point 40 can be secured to the housing 50 by a threaded connection 45. The refill cartridge 35 can be replaced by removing the pen point 40, and then removing a spent refill cartridge 35, inserting a new cartridge 35 in its place and reattaching the pen point 40.

In an alternative embodiment, the writing instrument 10 does not include the retractable pen, but the features of the clip 60 adjacent the stylus tip 20 and ribs 80 are still present.

In a further alternative, the refill cartridge 35 may be for any type of pen or pencil which can be extended through the pen point 40 by a twisting activation mechanism activated, by the pen activation cap 55. Thus, the refill cartridge 55 can be a roller ball, ball point pen, marker or pencil lead cartridge, among others.

Although the writing instrument 10 of the invention has been disclosed for use with handheld computing devices, it should be understood that the invention is adaptable for use with other devices having similar stylus ports.

While a specific embodiment of the invention has been shown and described in detail to illustrate the application of the principles of the invention, it will be understood that the invention may be embodied otherwise without departing from such principles.

What is claimed is:

1. A writing instrument for use with a computing device having a stylus port for receiving and holding the writing instrument, the writing instrument comprising:

an elongated housing adapted to fit in the stylus port having a first end and a second end;

a cap connected to the second end, the cap tapering from the second end to a cap top;

a generally elliptical clip located on a side of the cap and extending over at least a portion of the housing, the clip having at least one horizontal groove on an outward-facing surface of the clip;

a pair of detents, one detent in each side surface of the clip adjacent the second end of the housing for engaging corresponding projections in the stylus port;

a pair of longitudinal ribs positioned 180 degrees apart on the sides of the cap, the ribs spaced evenly on each side of the clip, the outer edge of the ribs defining a width equal to or greater than a diameter of the housing; and a stylus tip connected to the cap top.

2. A writing instrument according to claim 1, further comprising a pen point at the first end of the housing, a pen refill cartridge having a pen tip held within the housing, the pen tip being extendable and retractable through the pen point, the pen cap being rotatable relative to the housing for propelling an retracting the pen tip.

3. A writing instrument according to claim 2, wherein the pen tip is one of a ball point pen tip, a roller ball pen tip and a marker tip.

4. A writing instrument according to claim 1, wherein the at least one groove is three grooves.

5. A combined pen and stylus writing instrument for a handheld computing device having a stylus port for receiving the writing instrument, the writing instrument comprising:

a cylindrical housing having a pen point at one end;

a refill cartridge having a pen tip, the cartridge being removably held within the housing, the pen tip being extendable and retractable through the pen point;

a pen activation cap having a top end and rotatably connected to the other end of the cylindrical housing for propelling and retracting the pen tip when the pen activation cap is rotated relative to the housing;

a stylus tip secured to the top end of the pen activation cap;

a pair of detents, one detent in each side surface of the clip adjacent the second end of the housing for engaging corresponding projections in the stylus port.

6. A writing instrument according to claim 5, wherein the pen point is removable from the housing for replacing the refill cartridge.

7. A writing instrument according to claim 5, wherein the ribs have triangular shapes.

8. A writing instrument according to claim 5, wherein the clip is formed integral with the cap.

* * * * *